US012781609B2

(12) United States Patent
De Waele et al.

(10) Patent No.: US 12,781,609 B2
(45) Date of Patent: Nov. 3, 2026

(54) METHODS OF INTERPRETING A PLURALITY OF TIME-SERIES DATASETS GENERATED FROM OPERATION OF HYDROCARBON WELLS

(71) Applicant: ExxonMobil Technology and Engineering Company, Spring, TX (US)

(72) Inventors: Stijn De Waele, Flemington, NJ (US); Krishnan Kumaran, Raritan, NJ (US); David J. Schmidt, Morristown, NJ (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 539 days.

(21) Appl. No.: 17/999,178

(22) PCT Filed: Apr. 12, 2021

(86) PCT No.: PCT/US2021/026815
§ 371 (c)(1),
(2) Date: Nov. 17, 2022

(87) PCT Pub. No.: WO2021/252070
PCT Pub. Date: Dec. 16, 2021

(65) Prior Publication Data

US 2023/0220758 A1 Jul. 13, 2023

Related U.S. Application Data

(60) Provisional application No. 63/037,934, filed on Jun. 11, 2020.

(51) Int. Cl.

| | |
|---|---|
| ***E21B 43/267*** | (2006.01) |
| ***E21B 43/12*** | (2006.01) |
| ***E21B 43/29*** | (2006.01) |

(52) U.S. Cl.
CPC ..... *E21B 43/267* (2013.01); *E21B 43/12* (2013.01); *E21B 43/29* (2013.01)

(58) Field of Classification Search
None
See application file for complete search history.

(56) References Cited

U.S. PATENT DOCUMENTS

2012/0240072 A1* 9/2012 Altamura ..... G06T 11/206 345/440
2017/0140244 A1* 5/2017 Sharma ..... G06T 11/206

FOREIGN PATENT DOCUMENTS

WO 2011049648 A1 4/2011
WO 2013066358 A2 5/2013

OTHER PUBLICATIONS

Moritz et al., "Visualizing a Million Time Series with the Density Line Chart", arXiv:1808.06019v2, Sep. 6, 2018, 9 pages.

* cited by examiner

*Primary Examiner* — Matthew G Marini
(74) *Attorney, Agent, or Firm* — Troutman Pepper Locke LLP; John A. Morrissett; Scott A. Bergeson

(57) ABSTRACT

Methods of facilitating human interpretation of a plurality of time-series datasets generated from operation of hydrocarbon wells. The methods include obtaining the plurality of time-series datasets and displaying a vector map. The plurality of time-series datasets is generated from an operation of the hydrocarbon well and includes a first time-series dataset and a second time-series dataset, and optionally may include a third time-series dataset. The vector map includes a time axis and a plurality of points distributed along the time axis at a plurality of corresponding times. A color of each point of the plurality of points is defined in a plural-component color space and includes a first color component at a first intensity and a second color component at a second (Continued)

color component at a second intensity, and optionally a third color component at a third intensity when the plurality of time-series datasets includes a third time-series dataset.

20 Claims, 8 Drawing Sheets

METHODS OF INTERPRETING A PLURALITY OF TIME-SERIES DATASETS GENERATED FROM OPERATION OF HYDROCARBON WELLS

CROSS-REFERENCE TO RELATED APPLICATIONS

This application is the U.S. National Stage Application of International Application No. PCT/US21/026815, entitled "Methods of Interpreting a Plurality of Time-Series Datasets Generated From Operation of Hydrocarbon Wells," filed Apr. 12, 2021, the disclosure of which is hereby incorporated by reference in its entirety, which claims the benefit of U.S. Provisional Application Ser. No. 63/037,934, entitled "Methods of Interpreting a Plurality of Time-Series Datasets Generated From Operation of Hydrocarbon Wells," filed Jun. 11, 2020, the disclosure of which is hereby incorporated by reference in its entirety.

FIELD OF THE INVENTION

The present disclosure relates generally to methods of facilitating human interpretation of a plurality of time-series datasets and generated from operation of hydrocarbon wells.

BACKGROUND OF THE INVENTION

Drilling, completion, and/or production operations of hydrocarbon wells often may generate large numbers of time-series datasets that may be associated with a number of distinct variables. In general, it may be feasible to view, to interpret, and/or to compare a small number of such time-series datasets. As an example, various plotting, charting, and/or display methodologies are known. These display methodologies may be two-or-more dimensional and may utilize color. However, it may be challenging, or even impossible, to view, to interpret, and/or to compare a large number of such time-series datasets. Thus, there exists a need for improved methods of facilitating human interpretation of a plurality of time-series datasets generated from operation of hydrocarbon wells.

SUMMARY OF THE INVENTION

Methods of facilitating human interpretation of a plurality of time-series datasets and hydrocarbon wells that perform the methods. The methods include obtaining the plurality of time-series datasets and displaying a vector map. The plurality of time-series datasets is generated from an operation of the hydrocarbon well and includes at least a first time-series dataset and a second time-series dataset. The first time-series dataset includes values of a first variable at a plurality of corresponding times and the second time-series dataset includes values of a second variable at the plurality of corresponding times. The plurality of time-series datasets optionally further may include at least a third time-series dataset, and the third time-series dataset, when present, includes values of a third variable at the plurality of corresponding times.

The vector map includes a time axis and a plurality of points distributed along the time axis at a plurality of corresponding times. A color of each point of the plurality of points is defined in a plural-component color space and includes a first color component at a first intensity and a second color component at a second intensity. The first intensity at a given time of the plurality of corresponding times is based upon a magnitude of the first variable at the given time. The second intensity at the given time is based upon a magnitude of the second variable at the given time. When the plurality of time-series datasets includes a third time-series dataset, the color of each point of the plurality of points may include a third color component at a third intensity, with the third intensity at the given time being based upon a magnitude of the third variable at the given time.

DETAILED DESCRIPTION OF THE INVENTION

Figure 1:
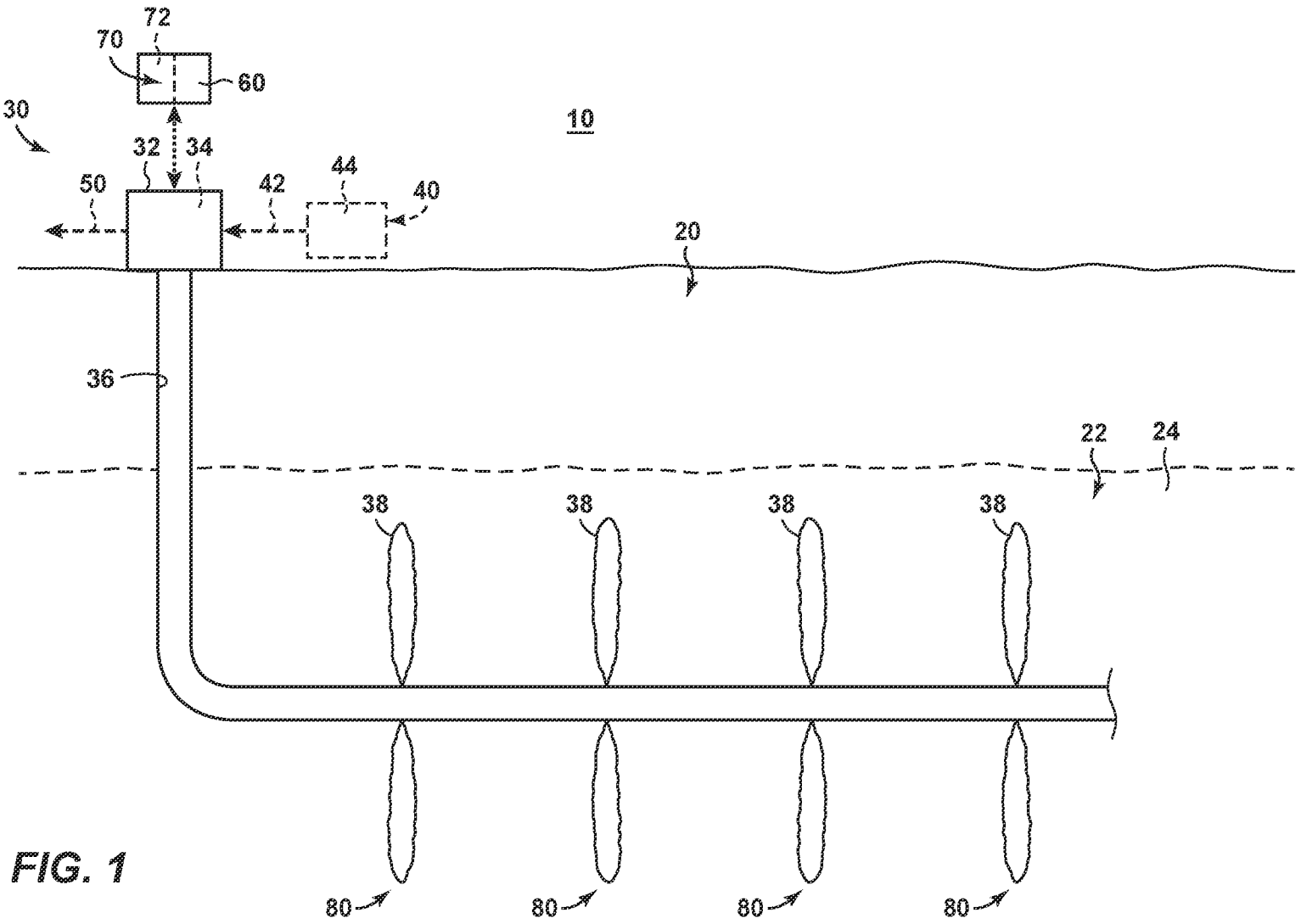
FIG. 1 is a schematic illustration of examples of a hydrocarbon well that that may be utilized to generate time-series datasets according to the present disclosure.

FIGS. 1-9 provide examples of hydrocarbon wells 30, of methods 100, and/or of vector maps, according to the present disclosure. Elements that serve a similar, or at least substantially similar, purpose are labeled with like numbers in each of FIGS. 1-9, and these elements may not be discussed in detail herein with reference to each of FIGS. 1-9. Similarly, all elements may not be labeled in each of FIGS. 1-9, but reference numerals associated therewith may be utilized herein for consistency. Elements, components, and/or features that are discussed herein with reference to one or more of FIGS. 1-9 may be included in and/or utilized with any of FIGS. 1-9 without departing from the scope of the present disclosure. In general, elements that are likely to be included in a particular embodiment are illustrated in solid lines, while elements that are optional are illustrated in dashed lines. However, elements that are shown in solid lines may not be essential and, in some embodiments, may be omitted without departing from the scope of the present disclosure.

FIG. 1 is a schematic illustration of examples of a hydrocarbon well 30 that may perform methods 100 and/or that may be utilized to generate time-series datasets, according to the present disclosure. Hydrocarbon well 30 includes a wellbore 36 that extends within a subsurface region 20.

Wellbore 36 also may be referred to herein as extending between a surface region 10 and a subterranean formation 22, which may include hydrocarbons 24. Hydrocarbon well 30 may include a wellhead 32 that may include a pressure sensor 34. Hydrocarbon well 30 also may include a slurry supply system 40, which may be configured to provide a slurry stream 42 to wellbore 36 at a slurry stream flow rate, which may be measured and/or determined by a slurry flow rate sensor 44.

Hydrocarbon well 30 also includes a display 60 and a computing device 70. Display 60 may, or may be utilized to, display vector maps according to methods 100 of FIG. 4. Computing device 70 may be programmed to direct display 60 to display the vector maps. Computing device 70 may include and/or be any suitable structure, device, and/or devices that may be adapted, configured, designed, constructed, and/or programmed to perform the functions discussed herein. This may include controlling the operation of the at least one other component of hydrocarbon well 30, such as via and/or utilizing methods 100, which are discussed in more detail herein. As examples, computing device 70 may include one or more of a controller, an electronic controller, a dedicated controller, a special-purpose controller, a personal computer, a special-purpose computer, a display device, a touch screen display, a logic device, a memory device, and/or a memory device having computer-readable storage media 72.

The computer-readable storage media, when present, also may be referred to herein as non-transitory computer-readable storage media. This non-transitory computer-readable storage media may include, define, house, and/or store computer-executable instructions, programs, and/or code; and these computer-executable instructions may direct hydrocarbon well 30 and/or computing device 70 thereof to perform any suitable portion, or subset, of methods 100. Examples of such non-transitory computer-readable storage media include CD-ROMs, disks, hard drives, flash memory, etc. As used herein, storage, or memory, devices and/or media having computer-executable instructions, as well as computer-implemented methods and other methods according to the present disclosure, are considered to be within the scope of subject matter deemed patentable in accordance with Section 101 of Title 35 of the United States Code.

A plurality of different and/or distinct operations may be performed on and/or utilizing hydrocarbon well 30. As an example, a drilling operation may be utilized to form, to define, and/or to drill wellbore 36. As another example, a plurality of completion operations may be utilized to form and/or define a plurality of fractures 38. Fractures 38 may extend from wellbore 36 and/or within subsurface region 20. In a specific example, the plurality of completion operations may be performed in a plurality of stages 80, with each stage 80 being utilized to define one or more fractures 38. In some such examples, slurry supply system 40 may be utilized to provide slurry stream 42 to wellbore 36, such as to pressurize the wellbore and thereby generate fractures 38. The slurry stream may be provided at a pressure, which may be measured by pressure sensor 34. The slurry stream may include a proppant at a known and/or specified proppant concentration.

Subsequent to completion of hydrocarbon well 30, production operations may be performed. Production operations may include flowing hydrocarbons 24 from subterranean formation 22 and/or into wellbore 36. The hydrocarbons then may flow to surface region 10 and be produced from the hydrocarbon well as a produced fluid stream 50.

Figure 2:
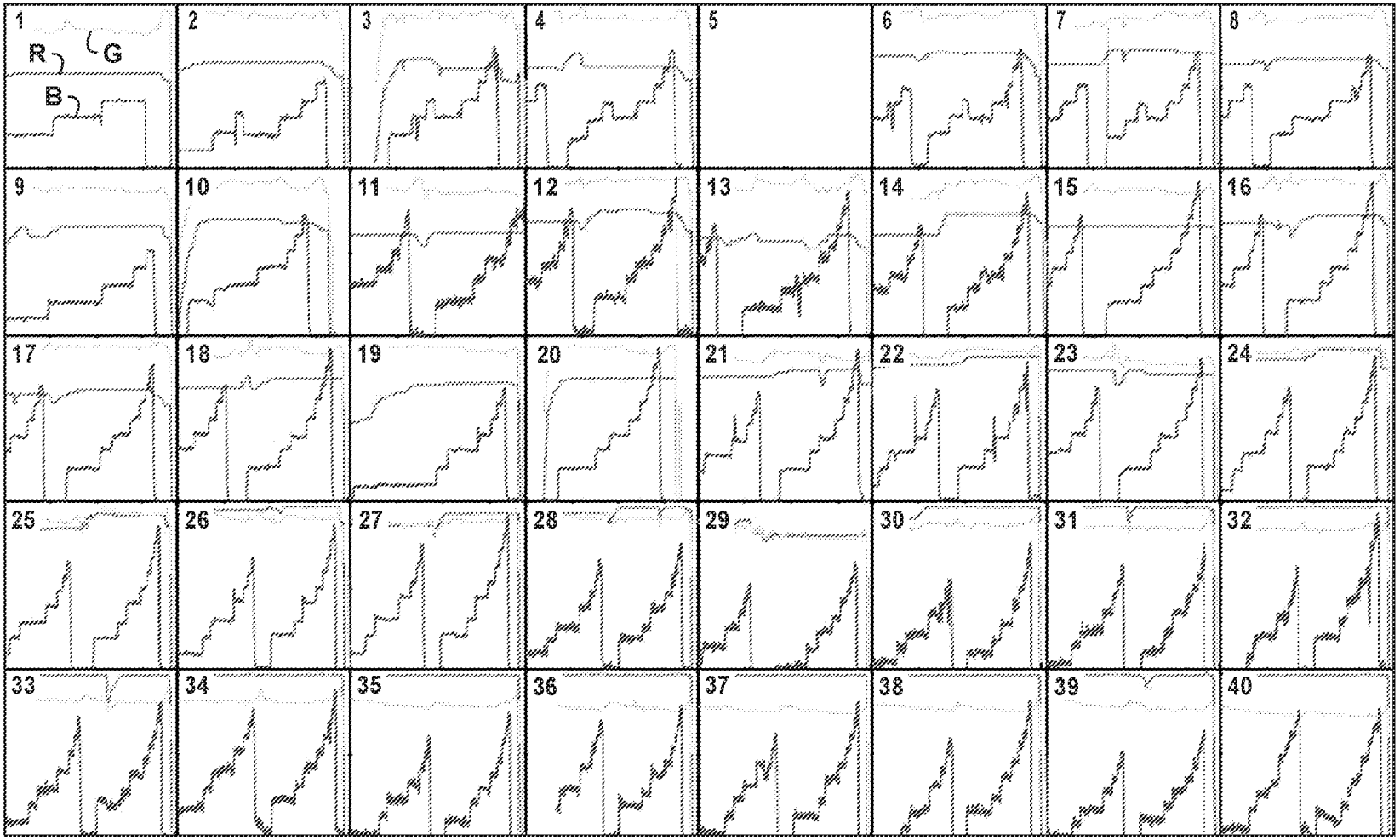
FIG. 2 is an illustration of examples of a plurality of individual time-series datasets that may be generated from operation of one or more hydrocarbon wells and/or that may be utilized with methods according to the present disclosure.

As discussed, operations performed on a hydrocarbon well 30 may generate large numbers of time-series datasets, and FIG. 2 is an illustration of examples of a plurality of individual time-series datasets that may be generated by one or more hydrocarbon wells 30 and/or that may be utilized with methods 100, according to the present disclosure. In the examples of FIG. 2, each individual time-series dataset (labelled 1-40) is generated during completion of a corresponding stage 80 of hydrocarbon well 30, such as is schematically illustrated in FIG. 1. Each time-series dataset plots values of a first variable, a second variable, and a third variable on the ordinate, or Y, axis as a function of time, on the abscissa, or X, axis. In the examples of FIG. 2, the red variable (R) denotes the slurry stream flow rate of the slurry stream that is provided to the wellbore, the green variable (G) denotes the pressure within the wellbore, and the blue variable (B) denotes the proppant concentration within the slurry stream.

It generally may be possible, or feasible, to manually and methodically compare individual time-series datasets, such as those that are illustrated in FIG. 2. As an example, a first time-series dataset for a first completion operation may be visually compared to a second time-series dataset for second completion operation. However, it becomes challenging to manually compare more than a small number of individual time-series datasets. It also is challenging, if not impossible, to manually correlate and/or identify trends and/or data interrelations among more than the small number of individual time-series datasets.

Figure 3:
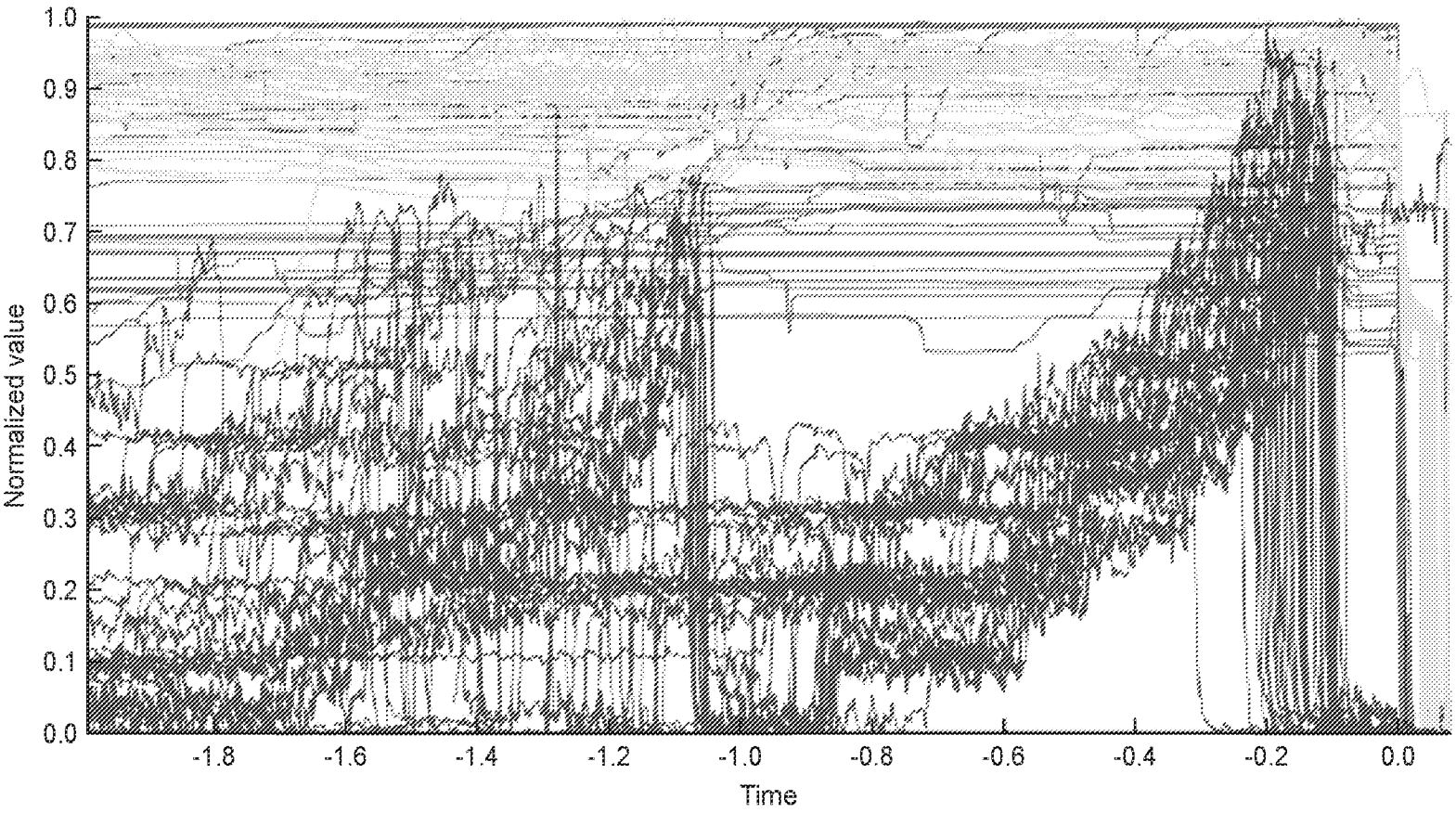
FIG. 3 is an illustration of an example of an overlay of the plurality of individual time-series datasets of FIG. 2.

In some instances, overlay plots may be utilized to aid in comparisons among individual time-series datasets. While such overlay plots may be effective for a small number of individual time-series datasets, they become ineffective for a large number of individual time-series datasets. This is illustrated by FIG. 3, which is an illustration of an example of an overlay of the plurality of individual time-series datasets of FIG. 2. It becomes clear that it is impossible to identify any significant trends, correlations, and/or comparisons from the overlay illustrated in FIG. 2.

Figure 4:
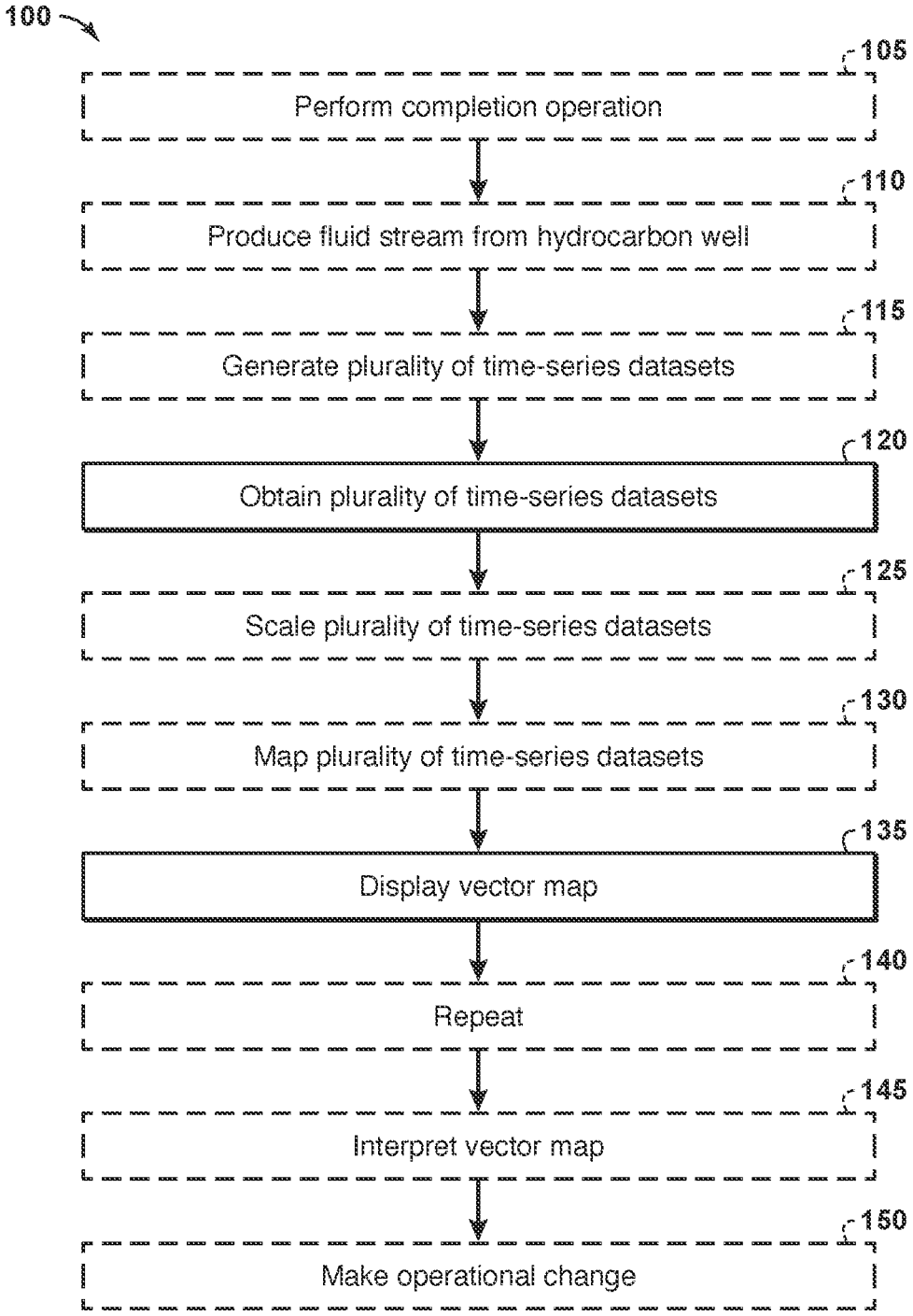
FIG. 4 is a flowchart depicting examples of methods of facilitating human interpretation of a plurality of time-series datasets according to the present disclosure.

With the above in mind, FIG. 4 is a flowchart depicting examples of methods 100 of facilitating human interpretation of a combined plurality of time-series datasets, such as the plurality of time-series datasets illustrated in FIG. 2, according to the present disclosure. Methods 100 may include performing a completion operation at 105, producing a fluid stream from a hydrocarbon well at 110, and/or generating a plurality of time-series datasets at 115. Methods 100 include obtaining the plurality of time-series datasets at 120 and may include scaling the plurality of time-series datasets at 125 and/or mapping the plurality of time-series datasets at 130. Methods 100 also include displaying a vector map at 135 and may include repeating at least a portion of the methods at 140, interpreting the vector map at 145, and/or making an operational change at 150.

The plurality of time-series datasets may be generated from and/or during an operation of the hydrocarbon well. Examples of the operation of the hydrocarbon well include a completion operation and/or a production operation and are discussed in more detail herein. The plurality of time-series datasets include at least a first time-series dataset and a second time-series dataset. In some examples, the plurality of time-series datasets further may include a third time-series dataset, or even more than three time-series datasets. The first time-series dataset may include values of a first variable at a plurality of corresponding times. The second time-series dataset may include values of a second variable at the plurality of corresponding times, and the third time-series dataset, when present, may include values of a third variable at the plurality of corresponding times.

For simplicity of discussion and illustration, the following will refer to methods 100 that utilizing the plurality of time-series datasets including the first time-series dataset, the second time-series dataset, and the third time-series dataset. However, and as discussed, it is within the scope of the present disclosure that methods 100 may be performed utilizing fewer than three time-series datasets, such as only the first time-series dataset and the second time-series dataset, and/or utilizing more than three time-series datasets, such as four time-series datasets or even more than four time-series datasets.

In some examples, the plurality of corresponding times may include and/or be a plurality of discrete corresponding times. In some such examples, the first time-series dataset, the second time-series dataset, and the third time-series dataset may include corresponding values of the first variable, the second variable, and the third variable, respectively, for at least a subset, or even for each, of the plurality of discrete corresponding times. Stated another way, values of the first variable, the second variable, and the third variable each may be collected and/or defined at the plurality of discrete corresponding times. Stated yet another way, each discrete corresponding time may have a single value of the first variable, a single value of the second variable, and a single value of the third variable associated therewith.

In some examples, the plurality of corresponding times may include and/or be a plurality of corresponding time ranges. In some such examples, the first time-series dataset, the second time-series dataset, and the third time-series dataset may include corresponding values of the first variable, the second variable, and the third variable, respectively, for and/or within at least a subset, or even each, of the plurality of corresponding time ranges. Stated another way, values of the first variable, the second variable, and the third variable each may be collected, defined, and/or associated with corresponding time ranges and/or each corresponding time range may have a single value of the first variable, a single value of the second variable, and a single value of the third variable associated therewith.

The first variable, the second variable, and/or the third variable may include and/or be any suitable variable, dependent variable, and/or independent variable that may be associated with and/or generated by the operation of the hydrocarbon well. Examples of the first variable, the second variable, and/or the third variable include one or more of a slurry flow rate of a slurry stream provided to the hydrocarbon well during a completion operation of the hydrocarbon well, a proppant concentration of a proppant in the slurry stream during the completion operation of the hydrocarbon well, a pressure generated within the wellbore when the slurry stream is provided to the hydrocarbon well during the completion operation of the hydrocarbon well, a flow resistance of the hydrocarbon well during the completion operation of the hydrocarbon well, a water production rate during production from the hydrocarbon well, a liquid hydrocarbon production rate during production from the hydrocarbon well, a gaseous hydrocarbon production rate during production from the hydrocarbon well, total production from the hydrocarbon well, and/or hydrocarbon production from the hydrocarbon well. Several of these examples of variables are discussed in more detail herein for context and illustration.

Performing the completion operation at 105 may include performing any suitable completion operation of and/or on the hydrocarbon well. This may include performing the completion operation to permit and/or facilitate the generating at 115, when performed. Examples of the completion operation include any suitable stimulation operation and/or hydraulic fracturing operation. In a specific example, the completion operation may include providing a slurry stream to the hydrocarbon well, such as with, via, and/or utilizing slurry supply system 40 of FIG. 1.

The performing at 105 may be performed with any suitable timing and/or sequence during methods 100. As examples, the performing at 105 may be performed prior to the producing at 110, prior to and/or at least partially concurrently with the generating at 115, prior to and/or at least partially concurrently with the obtaining at 120, prior to and/or at least partially concurrently with the scaling at 125, prior to and/or at least partially concurrently with the mapping at 130, prior to and/or at least partially concurrently with the displaying at 135, prior to and/or at least partially concurrently with the repeating at 140, prior to and/or at least partially concurrently with the interpreting at 145, and/or prior to and/or at least partially concurrently with the making at 150.

Producing the fluid stream from the hydrocarbon well at 110 may include producing any suitable produced fluid stream from the hydrocarbon well. This may include flowing hydrocarbons from a subterranean formation and/or into a wellbore of the hydrocarbon well. Additionally or alternatively, the producing at 110 may include flowing the hydrocarbons to the surface region via the wellbore.

The producing at 110 may be performed with any suitable timing and/or sequence during methods 100. As examples, the producing at 110 may be performed subsequent to the performing at 105, prior to and/or at least partially concurrently with the generating at 115, prior to and/or at least partially concurrently with the obtaining at 120, prior to and/or at least partially concurrently with the scaling at 125, prior to and/or at least partially concurrently with the mapping at 130, prior to and/or at least partially concurrently with the displaying at 135, prior to and/or at least partially concurrently with the repeating at 140, prior to and/or at least partially concurrently with the interpreting at 145, and/or prior to and/or at least partially concurrently with the making at 150.

Generating the plurality of time-series datasets at 115 may include generating the plurality of time-series datasets in any suitable manner. As an example, the generating at 115 may include generating the plurality of time-series datasets during, as a result of, and/or responsive to the performing at 105 and/or the producing at 110.

As a more specific example, and such as when methods 100 include the performing at 105, the generating at 115 may include generating the plurality of time-series datasets during the completion operation of the hydrocarbon well. In some such examples, and when the performing at 105 includes providing the slurry stream to the hydrocarbon well, the generating at 115 may include monitoring and/or recording a slurry flow rate of the slurry stream, a proppant concentration within the slurry stream, and/or a pressure generated within the wellbore as a function of time during the providing the slurry stream. In some such examples, the first variable may include and/or be the slurry flow rate, the second variable may include and/or be the proppant concentration, and the third variable may include and/or be the pressure.

As another more specific example, and such as when methods 100 include the producing at 110, the generating at 115 may include generating the plurality of time-series datasets during production from the hydrocarbon well. In some such examples, the generating at 115 may include monitoring and/or recording a water production rate during production from the hydrocarbon well, a liquid hydrocarbon production rate during production from the hydrocarbon well, and/or a gaseous hydrocarbon production rate during production from the hydrocarbon well. In some such examples, the first variable may include and/or be the water production rate, the second variable may include and/or be the liquid hydrocarbon production rate, and the third variable may include and/or be the gaseous hydrocarbon production rate.

The generating at 115 may be performed with any suitable timing and/or sequence during methods 100. As examples, the generating at 115 may be performed at least partially concurrently with and/or as a result of the performing at 105, at least partially concurrently with and/or as a result of the producing at 110, prior to and/or at least partially concurrently with the obtaining at 120, prior to and/or at least partially concurrently with the scaling at 125, prior to and/or at least partially concurrently with the mapping at 130, prior to and/or at least partially concurrently with the displaying at 135, prior to and/or at least partially concurrently with the repeating at 140, prior to and/or at least partially concurrently with the interpreting at 145, and/or prior to and/or at least partially concurrently with the making at 150.

Obtaining the plurality of time-series datasets at 120 may include obtaining the plurality of time-series datasets in any suitable manner. As an example, the obtaining at 120 may be responsive to and/or a result of the performing at 105, the producing at 110, and/or the generating at 115. As another example, the obtaining at 120 may include accessing and/or downloading the plurality of time-series datasets, such as from a repository of, or from a database that includes, the plurality of time-series datasets.

Scaling the plurality of time-series datasets at 125 may include scaling the plurality of time-series datasets, or each time-series dataset of the plurality of time-series datasets, to produce and/or generate a plurality of scaled time-series datasets. The scaling at 125 may include scaling the plurality of time-series datasets in any suitable manner. As an example, the scaling at 125 may include scaling the plurality of time-series datasets such that values of the corresponding variable of each time-series dataset range are between a minimum scale value and a maximum scale value. Stated another way, the scaling at 125 may include scaling the plurality of time-series datasets such that values within each dataset fall within a predetermined, a predefined, and/or a similar value range. Stated yet another way, the scaling at 125 may include normalizing the plurality of time-series datasets. The scaling at 125 additionally or alternatively may include scaling such that a minimum value, or a minimum variable value, of each scaled time-series dataset is the minimum variable scale value, such as 0, and/or such that a maximum value, or a maximum variable value, of each scaled time-series dataset is the maximum variable scale value, such as 1.

In some examples, the scaling at 125 may include linearly scaling the plurality of time-series datasets to produce and/or generate the plurality of scaled time-series datasets. In a specific example, the scaling at 125 may include scaling the plurality of time-series datasets according to Equation (1).

$$R(s) = \frac{\min(\max(s, s_{low}), s_{high})}{s_{high} - s_{low}} \quad (1)$$

where R(s) is the value of a given scaled time-series dataset of the plurality of time-series datasets at the given time, s is the value of a corresponding time-series dataset of the plurality of time-series datasets at the given time, $s_{high}$ is a high truncation value for the corresponding time-series dataset, and $s_{low}$ is a low truncation value for the corresponding time-series dataset.

In another specific example, the scaling at 125 may include performing the mapping to map the plurality of time-series datasets, or the corresponding variable values thereof, to a corresponding plurality of color component intensity values. Stated another way, the scaling at 125 may include assigning a corresponding color component intensity value to each corresponding variable value, or range of corresponding variable values, for each time-series dataset.

In some examples, the scaling at 125 additionally or alternatively may include filtering at least one outlier value from at least one time-series dataset and/or scaling to decrease a magnitude of the outlier value. As an example, the max function of Equation 1 assigns a value of $s_{high}$ to outlier values that are greater than $s_{high}$ and/or assigns a value of $s_{low}$ to outlier values that are less than $s_{low}$. As another example, the plurality of time-series datasets may be mapped to a sigmoid function, or any other suitable function, to filter at least one outlier value and/or to decrease the magnitude of the outlier value.

The scaling at 125 may be performed with any suitable timing and/or sequence during methods 100. As examples, the scaling at 125 may be performed subsequent to and/or at least partially concurrently with the performing at 105, subsequent to and/or at least partially concurrently with the producing at 110, subsequent to and/or at least partially concurrently with the generating at 115, subsequent to and/or at least partially concurrently with the obtaining at 120, prior to and/or at least partially concurrently with the mapping at 130, prior to and/or at least partially concurrently with the displaying at 135, prior to and/or at least partially concurrently with the repeating at 140, prior to and/or at least partially concurrently with the interpreting at 145, and/or prior to and/or at least partially concurrently with the making at 150.

Mapping the plurality of time-series datasets at 130 may include mapping each time-series dataset of the plurality of time-series datasets to the corresponding plurality of color component intensity values. In some examples, the mapping at 130 may include mapping a raw, an original, and/or an unscaled time-series dataset to the corresponding plurality of color component intensity values. Additionally or alternatively, and when methods 100 include the scaling at 125, the mapping at 130 may include mapping the plurality of scaled time-series datasets to the corresponding plurality of color component intensity values.

The plurality of color component intensity values may range between a minimum color component value and a maximum color component value. An example of the corresponding plurality of color component intensity values, which may be utilized with common color spaces, include integer values from 0 to 255 (e.g., 8-bit color depth), with 0 representing the minimum color component value and 255 representing the maximum color component value. However, other color component intensity values and/or ranges also are within the scope of the present disclosure, such as a greater or lower number of color component intensity values and/or ranges.

In a specific example, the mapping at 130 may include sequentially assigning and/or mapping a range of values for each corresponding variable of the plurality of time-series datasets and/or for each corresponding variable of the plurality of scaled time-series datasets to a corresponding value of the corresponding plurality of color component intensity values. As a simplified example, the plurality of color component intensity values may include integer values from 0 to 9 and the range of values for each corresponding variable may range from 0 to 1. In such an example, the mapping at 130 may include assigning a color component intensity value of 0 to values to each corresponding variable with a value from 0 to 0.1, assigning a color component intensity value of 1 to each corresponding variable with a value from 0.1 to 0.2, etc.

In another specific example, the first color component may have a corresponding plurality of discrete first color component intensity values, the second color component may have a corresponding plurality of discrete second color component intensity values, and the third color component may have a corresponding plurality of discrete third color component intensity values. In this example, the mapping at 130 may include assigning a corresponding discrete first color component intensity value to the first variable at each time of the plurality of corresponding times, assigning a corresponding discrete second color component intensity value to the second variable at each time of the plurality of corresponding times, and/or assigning a corresponding discrete third color component intensity value to the third variable at each time of the plurality of corresponding times.

It is within the scope of the present disclosure that the mapping at 130 may include mapping the plurality of time-series datasets to any suitable corresponding plurality of color component intensity values that may be utilized with any suitable color space, or plural-component color space. An example of the color space includes a two-component color space, such as a black-and-white color space. Additional examples of the color space include a three-component color space, such as an RGB (red-green-blue) three-component color space, a YUV (luma-blue projection-red projection) three-component color space, and/or a CMY (cyan-magenta-yellow) three-component color space. Further examples of the color space include a four-component color space and/or a color space with more than four components.

Figure 5:
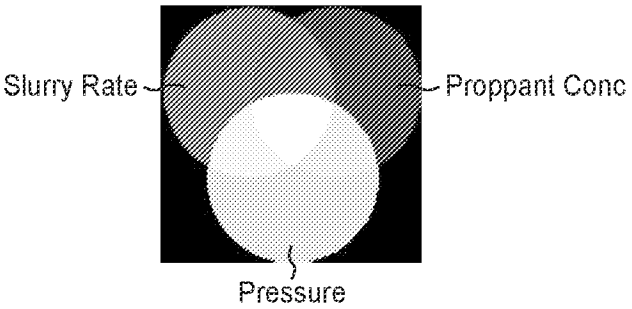
FIG. 5 is an illustration of a color space that may be utilized with methods according to the present disclosure.

An example of an RGB three-component color space is illustrated in FIG. 5. This RGB three-component color space is utilized herein for consistency; however, it is understood that other color spaces, including those that are disclosed herein, also may be utilized without departing from the scope of the present disclosure.

The mapping at 130 may be performed with any suitable timing and/or sequence during methods 100. As examples, the mapping at 130 may be performed subsequent to and/or at least partially concurrently with the performing at 105, subsequent to and/or at least partially concurrently with the producing at 110, subsequent to and/or at least partially concurrently with the generating at 115, subsequent to and/or at least partially concurrently with the obtaining at 120, subsequent to and/or at least partially concurrently with the scaling at 125, prior to and/or at least partially concurrently with the displaying at 135, prior to and/or at least partially concurrently with the repeating at 140, prior to and/or at least partially concurrently with the interpreting at 145, and/or prior to and/or at least partially concurrently with the making at 150.

Displaying the vector map at 135 may include displaying any suitable vector map on any suitable display. The vector map includes a time axis and a plurality of points distributed along the time axis at a plurality of corresponding times. A color of each point of the plurality of points is defined in a plural-component color space and includes a first color component at a first intensity, a second color component at a second intensity, and a third color component at a third intensity. The first intensity at a given time of the plurality of corresponding times is based, at least in part, upon a magnitude of the first variable at the given time. Similarly, the second intensity at the given time of the plurality of corresponding times is based, at least in part, upon a magnitude of the second variable at the given time. In addition, the third intensity at the given time is based, at least in part, upon a magnitude of the third variable at the given time. When methods 100 include the scaling at 125, the first intensity, the second intensity, and the third intensity may be based upon the plurality of scaled time-series datasets. When methods 100 include the mapping at 130, the first intensity, the second intensity, and the third intensity may be based upon the corresponding plurality of color component intensity values.

Figure 6:
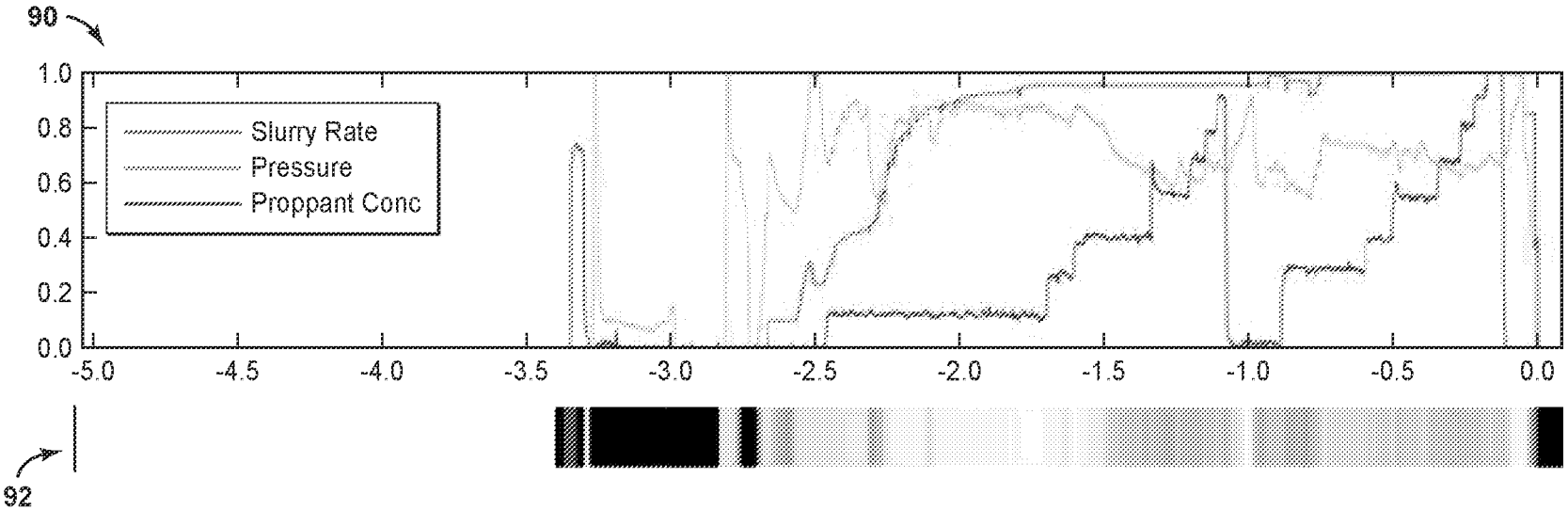
FIG. 6 is an illustration of an example of a plurality of time-series datasets and a corresponding vector map that may be generated utilizing methods according to the present disclosure.

It is within the scope of the present disclosure that the displaying at 135 additionally or alternatively may include generating image file data that may be representative of the vector map. This may permit and/or facilitate displaying the vector map at a later point in time, transferring the vector map, storing the vector map, and/or displaying the vector map on a plurality of different displays. Examples of the image file data include conventional image file formats, such as Joint Photographic Experts Group (JPEG), Graphics Interchange Format (GIF), Tagged Image File Format (TIFF), and/or Portable Network Graphics (PNG). FIG. 6 is an illustration of an example of a plot 90 of a plurality of time-series datasets and a corresponding vector map 92 that may be generated utilizing methods 100 and/or that may be displayed during the displaying at 135. More specifically, plot 90 of FIG. 6 illustrates slurry flow rate as a function of time in red, pressure as a function of time in green, and proppant concentration as a function of time in blue. For consistency and ease of illustration, the same colors are assigned to these variables in plot 90, the corresponding vector map 92, and the other vector maps 92 that are illustrated and/or discussed herein. In the vector map, and as discussed, the intensity of each color is based upon the magnitude of the corresponding variable, with the intensity increasing with an increase in the magnitude of the corresponding variable. The various colors of the vector map at a given point in time correspond to various combinations of the colors, and corresponding intensities, of the three time-series datasets at the given point in time. As such, the vector map provides a simplified visual representation of the values of the three time-series datasets and/or of the relative magnitudes thereof.

As illustrated in FIG. 6, the plurality of points in the vector map may include and/or be a plurality of rectangular and/or square points, although other shapes or indicia may be utilized without departing from the scope of the present disclosure. As also illustrated in FIG. 6, the plurality of points may be adjacent one another and/or may extend along the time axis, such as to form and/or define a colored bar, which is an example of vector maps according to the present disclosure.

The displaying at 135 may be performed with any suitable timing and/or sequence during methods 100. As examples, the displaying at 135 may be performed subsequent to and/or at least partially concurrently with the performing at 105, subsequent to and/or at least partially concurrently with the producing at 110, subsequent to and/or at least partially concurrently with the generating at 115, subsequent to and/or at least partially concurrently with the obtaining at 120, subsequent to and/or at least partially concurrently with the scaling at 125, subsequent to and/or at least partially concurrently with the mapping at 130, prior to and/or at least partially concurrently with the repeating at 140, prior to and/or at least partially concurrently with the interpreting at 145, and/or prior to and/or at least partially concurrently with the making at 150.

Repeating at least the portion of the methods at 140 may include repeating any suitable step and/or steps of methods 100 in any suitable order, for any suitable purpose, and/or any suitable number of times. As examples, the repeating at 140 may include repeating the performing at 105, the producing at 110, the generating at 115, the obtaining at 120, the scaling at 125, the mapping at 130, and/or the displaying at 135 at least 2, at least 4, at least 6, at least 8, at least 10, at least 15, at least 20, at most 50, at most 40, at most 30, at most 20, at most 15, and/or at most 10 times.

Figure 7:
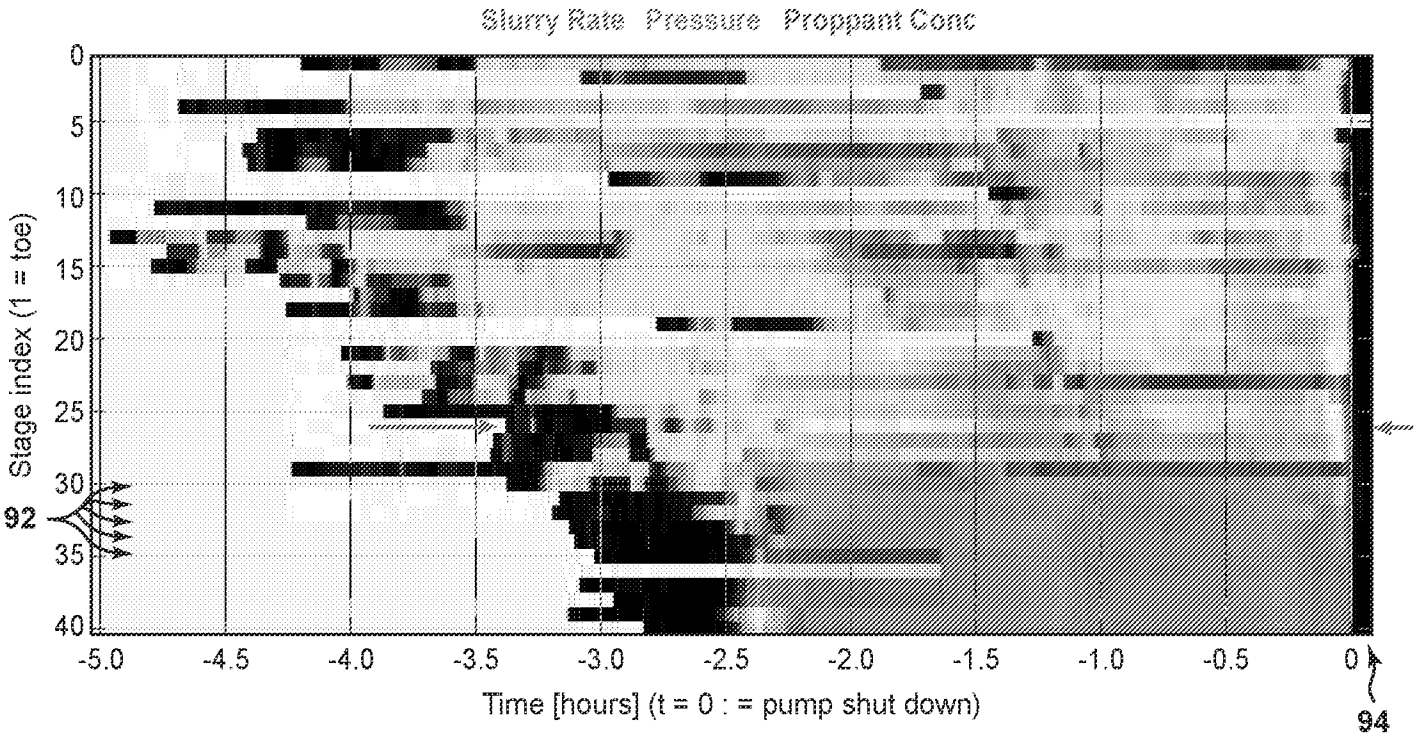
FIG. 7 is an illustration of an example of a plurality of vector maps that may be generated by methods according to the present disclosure.

In some examples, the operation may include and/or be a first instance of the operation, and the plurality of time-series datasets may be a first plurality of time-series datasets generated during and/or associated with the first instance of the operation. In such an example, the vector map may include and/or be a first vector map, and the repeating at 140 may include repeating at least the obtaining at 120 and the displaying at 135 a plurality of times to concurrently display a plurality of distinct vector maps, with each vector map of the plurality of distinct vector maps being derived from a corresponding distinct instance of the operation. This is illustrated in FIG. 7, which is an illustration of an example of a plurality of vector maps that may be generated by methods 100. The example of FIG. 7 includes 40 distinct vector maps and includes the vector map of FIG. 6, which is indicated by the red arrows.

As a more specific example, and as discussed, a completion operation on a given hydrocarbon well may include completing a plurality of distinct stages of the hydrocarbon well. With this in mind, the repeating at 140 may include displaying a plurality of distinct vector maps that includes a corresponding vector map for each stage of the completion operation, as illustrated by the 40 distinct vector maps of FIG. 7.

When methods 100 include the repeating at 140, repetition of the displaying at 135 may include arranging the plurality of distinct vector maps such that the plurality of distinct vector maps extends along a single time axis (i.e., the abscissa, or X, axis of FIG. 7) and/or stacking, or vertically stacking, the plurality of distinct vector maps. Such a combining methodology may permit and/or facilitate relative comparisons among the plurality of distinct instances of the operation. This may include comparisons of the durations of the plurality of distinct instances of the operation and/or comparisons of various trends with respect to the plurality of time-series datasets during the plurality of distinct instances of the operation. The results of the combining methodology facilitates viewing the data sets at a selected simultaneous arrangement.

In some examples, and when methods 100 include the repeating at 140, each operation of the plurality of distinct instances of the operation may include an operational feature. In some such examples, the repetition of the displaying at 135 may include aligning the plurality of distinct vector maps such that the operational feature of each operation occurs at the same time along the time axis. Such a configuration may permit and/or facilitate relative comparisons among the plurality of distinct vector maps by aligning the plurality of distinct vector maps with respect to the operational feature. In FIG. 7, a shut-in time of the completion operations utilized to generate vector maps 92 are aligned along the time axis.

In some examples, the repeating at 140 additionally or alternatively may include repeating at least the obtaining at 120 and the displaying at 135 to display a desired, a theoretical, and/or a planned vector map for the operation of the hydrocarbon well. Stated another way, and prior to performing the operation, values of variables included in the plurality of time-series datasets may be estimated and/or initial values may be established. With this in mind, displaying the desired, theoretical, and/or planned vector map may permit and/or facilitate comparisons between ideal and/or predicted values of the plurality of time-series datasets and actual values of the plurality of time-series datasets obtained while performing the operation of the hydrocarbon well.

In some examples, the repeating at 140 additionally or alternatively may include repeating at least the obtaining at 120 and the displaying at 135 to display a deviation, or a difference, vector map that illustrates differences between the desired, theoretical, and/or planned vector map and the vector map generated from the plurality of time-series datasets obtained while performing the operation of the hydrocarbon well. Such a configuration may permit and/or facilitate identification of operational regimes that differ from the desired, theoretical, and/or planned operational regimes.

In some examples, methods 100, the displaying at 135, and/or repetition of the displaying at 135 may include displaying at least one additional parameter, which may be associated with each of the plurality of distinct instances of the operation of the hydrocarbon well. The at least one additional parameter may be displayed as part of and/or may be associated with each vector map of the plurality of distinct vector maps.

Figure 8:
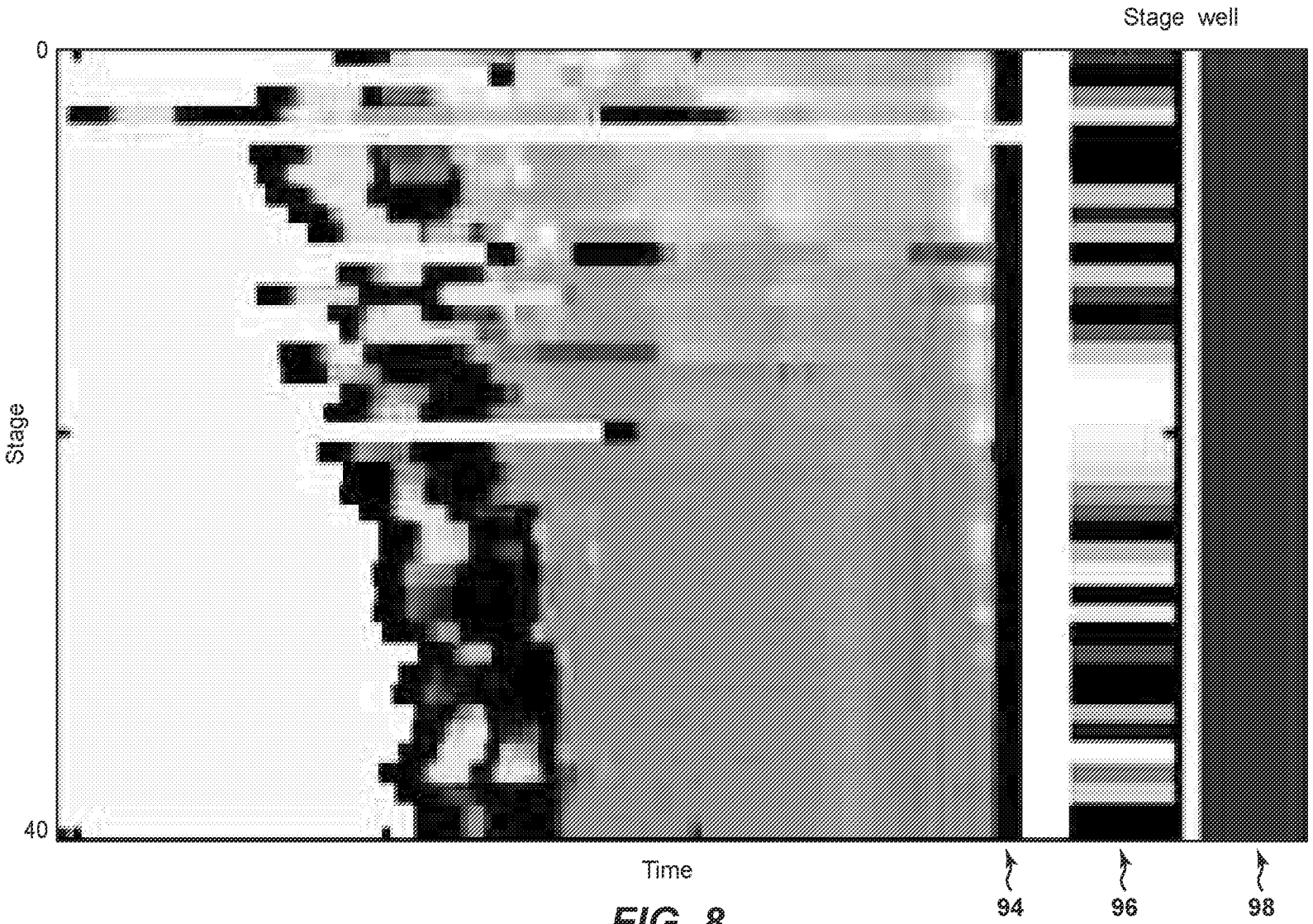
FIG. 8 is another illustration of an example of a plurality of vector maps that may be generated by methods according to the present disclosure.

An example of the at least one additional parameter includes post shut-in data. In a specific example, the at least one additional parameter may include and/or be a production rate associated with each of the plurality of distinct instances of the operation of the hydrocarbon well. This example is illustrated in FIG. 8, which illustrates post shut-in data 96 to the right of shut-in time 94. In the specific example of FIG. 8, vector maps 92 correspond to various completion stages of a hydrocarbon well, and post shut-in data 96 corresponds to production rates obtained from the various completion stages of the hydrocarbon well. Such methods may permit and/or facilitate identification of trends in post shut-in data 96, such as production rates, that may be caused and/or obtained by, for example, variations in slurry flow rate, pressure, and/or proppant concentration during completion of the various stages of the hydrocarbon well and/or that may vary with position within the hydrocarbon well.

In some examples, the hydrocarbon well may include and/or be a first hydrocarbon well. In some such examples, the operation may be a first operation of the first hydrocarbon well, the plurality of time-series datasets may include and/or be a first plurality of time-series datasets generated during the first operation of the first hydrocarbon well, and/or the vector map may include and/or be a first vector map. In such examples, the repeating at 140 may include repeating at least the displaying at 135 a plurality of times to concurrently display a plurality of distinct vector maps for a plurality of distinct instances of the operation of a plurality of distinct hydrocarbon wells. Stated another way, the repeating at 140 may include repeating the displaying at 135 to display a corresponding vector map for each hydrocarbon well of the plurality of distinct hydrocarbon wells. Such methods may permit and/or facilitate comparison of operational parameters among the plurality of distinct hydrocarbon wells.

Figure 9:
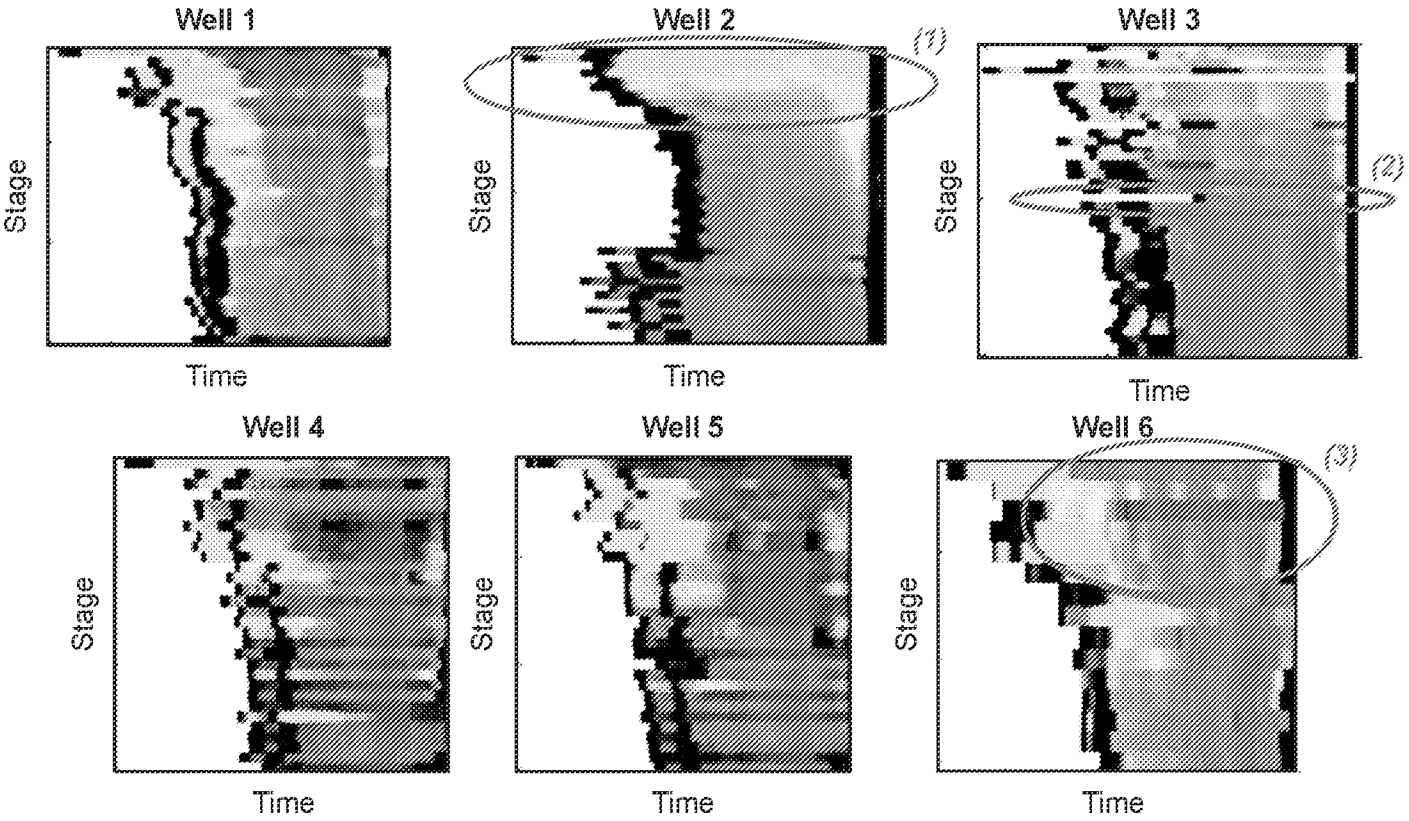
FIG. 9 is an illustration of examples of comparisons among a plurality of hydrocarbon wells that may be facilitated utilizing methods according to the present disclosure.

This is illustrated in FIG. 9, which illustrates a plurality of vector maps obtained during completion operations of a plurality of distinct hydrocarbon wells, which are indicated as well 1, well 2, well 3, well 4, well 5, and well 6. The visualization illustrated in FIG. 9 may provide distinct benefits that may permit an operator of the hydrocarbon well to visually identify trends that otherwise would be difficult, or even impossible, to identify.

As an example, and as indicated by the circle labeled (1), well 2 utilized relatively higher pressures (more green in the vector maps) for the first few (deeper) completion stages and relatively lower pressures thereafter. It may be possible to correlate these higher pressures to formation geology and/or obtained production ranges.

As another example, and as indicated by the circle labeled (2), well 3 has a very short completion stage. It is possible that the data associated with this completion stage are corrupt and/or that there was an issue with this completion stage. As such, it may be appropriate to consider excluding this completion stage from subsequent analyses.

As another example, and as indicated by the circle labeled (3), well 6 had relatively higher slurry flow rates for several of the early completion stages. It may be possible to correlate these higher slurry flow rates to changes in production rates and/or completion operation duration.

In some examples, methods 100, the displaying at 135, and/or repetition of the displaying at 135 further may include displaying overall well data, such as an overall production rate from the hydrocarbon well. This is illustrated in FIG. 8 at 98. Such methods may permit and/or facilitate comparisons of production rates among a plurality of distinct hydrocarbon wells.

The repeating at 140 may be performed with any suitable timing and/or sequence during methods 100. As examples, the repeating at 140 may be performed subsequent to and/or at least partially concurrently with the performing at 105, subsequent to and/or at least partially concurrently with the producing at 110, subsequent to and/or at least partially concurrently with the generating at 115, subsequent to and/or at least partially concurrently with the obtaining at 120, subsequent to and/or at least partially concurrently with the scaling at 125, subsequent to and/or at least partially concurrently with the mapping at 130, subsequent to and/or at least partially concurrently with the displaying at 135, subsequent to, prior to, and/or at least partially concurrently with the interpreting at 145, and/or subsequent to, prior to, and/or at least partially concurrently with the making at 150.

Interpreting the vector map at 145 may include interpreting the vector map to determine at least one property of the operation. Examples of the at least one property of the operation include a completion efficiency of the hydrocarbon well, a stage-to-stage completion efficiency of the hydrocarbon well, a vendor-to-vendor completion efficiency of the hydrocarbon well, a production rate from the hydrocarbon well, and/or a cost effectiveness of the hydrocarbon well. Methods 100 and/or the interpreting at 145 additionally or alternatively may include correlating the vector map with a geology of a subterranean formation within which the hydrocarbon well extends.

The interpreting at 145 may be performed with any suitable timing and/or sequence during methods 100. As examples, the interpreting at 145 may be performed subsequent to and/or at least partially concurrently with the performing at 105, subsequent to and/or at least partially concurrently with the producing at 110, subsequent to and/or at least partially concurrently with the generating at 115, subsequent to and/or at least partially concurrently with the obtaining at 120, subsequent to and/or at least partially concurrently with the scaling at 125, subsequent to and/or at least partially concurrently with the mapping at 130, subsequent to and/or at least partially concurrently with the displaying at 135, subsequent to, prior to, and/or at least partially concurrently with the repeating at 140, and/or subsequent to, prior to, and/or at least partially concurrently with the making at 150.

Making the operational change at 150 may include making any suitable operational change based, at least in part, on the vector map. Examples of the at least one operational change include a change in at least one parameter of a subsequent operation performed on the hydrocarbon well and/or a change in at least one parameter of a subsequent operation performed on a different hydrocarbon well.

The making at 150 may be performed with any suitable timing and/or sequence during methods 100. As examples, the making at 150 may be performed subsequent to and/or at least partially concurrently with the performing at 105, subsequent to and/or at least partially concurrently with the producing at 110, subsequent to and/or at least partially concurrently with the generating at 115, subsequent to and/or at least partially concurrently with the obtaining at 120, subsequent to and/or at least partially concurrently with the scaling at 125, subsequent to and/or at least partially concurrently with the mapping at 130, subsequent to and/or at least partially concurrently with the displaying at 135, subsequent to, prior to, and/or at least partially concurrently with the repeating at 140, and/or subsequent to, prior to, responsive to, and/or at least partially concurrently with the interpreting at 145.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

INDUSTRIAL APPLICABILITY

The systems and methods disclosed herein are applicable to the hydrocarbon well drilling, hydrocarbon well completion, and hydrocarbon production industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions, and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements, and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. A method of interpreting a plurality of time-series datasets generated from operation of a hydrocarbon well, the method comprising: obtaining the plurality of time-series datasets, wherein the plurality of time-series datasets is generated from an operation of a hydrocarbon well and includes a first time-series dataset that includes values of a first variable at a plurality of corresponding times, a second time-series dataset that includes values of a second variable at the plurality of corresponding times, and a third time-series dataset that includes values of a third variable at the plurality of corresponding times;

displaying a vector map, wherein the vector map includes a time axis and a plurality of points distributed along the time axis at the plurality of corresponding times, wherein a color of each point of the plurality of points is defined in a plural-component color space and includes a first color component at a first intensity, a second color component at a second intensity, and a third color component at a third intensity, wherein the color of each point of the plurality of points comprises a composite color formed by combining the first color component, the second color component, and the third color component such that each point of the plurality of points represents a combination of various magnitudes of at least the first variable, the second variable and the third variable at a particular point in time, and further wherein:

(i) the first intensity at a given time of the plurality of corresponding times is based upon a magnitude of the first variable at the given time;

(ii) the second intensity at the given time is based upon a magnitude of the second variable at the given time; and (iii) the third intensity at the given time is based upon a magnitude of the third variable at the given time; and making an operational change based on the vector map, wherein the operational change comprises modifying at least one parameter of a subsequent operation performed on the hydrocarbon well.

2. The method of claim 1, wherein, prior to the displaying, the method further includes scaling the plurality of time-series datasets to generate a plurality of scaled time-series datasets, wherein the first intensity and the second intensity are based upon the plurality of scaled time-series datasets, and wherein the plurality of time-series datasets includes the third time-series dataset and the third intensity is based upon the plurality of scaled time-series datasets.

3. The method of claim 2, wherein the scaling the plurality of time-series datasets includes scaling such that the values of a corresponding variable of each time-series dataset range between a minimum variable scale value and a maximum variable scale value.

4. The method of claim 3, wherein a minimum variable value of each scaled time-series dataset of the plurality of time-series datasets is the minimum variable scale value.

5. The method of claim 3, wherein a maximum variable value of each scaled time-series dataset of the plurality of time-series datasets is the maximum variable scale value.

6. The method of claim 3, wherein the minimum variable scale value is 0 and the maximum variable scale value is 46.

7. The method of claim 2, wherein the scaling the plurality of time-series datasets includes linearly scaling the plurality of time-series datasets.

8. The method of claim 2, wherein the scaling the plurality of time-series datasets further includes filtering at least one outlier value from at least one time-series dataset of the plurality of time-series datasets.

9. The method of claim 2, wherein the scaling the plurality of time-series datasets includes scaling according to the formula:

$$R(s) = \frac{\min(\max(S, S_{low}), S_{high})}{S_{high} - S_{low}}$$

where R(s) is the value of a given scaled time-series dataset of the plurality of time-series datasets at the given time, s is the value of a corresponding time-series dataset of the plurality of time-series datasets at the given time, $S_{high}$ is a high truncation value for the corresponding time-series dataset, and $S_{low}$ is a low truncation value for the corresponding time-series dataset.

10. The method of claim 1, wherein, prior to the displaying, the method further includes mapping each time-series dataset of the plurality of time-series datasets to a corresponding plurality of color component intensity values.

11. The method of claim 10, wherein at least one of:

(i) the first color component has a corresponding plurality of discrete first color component intensity values, and further wherein the mapping includes assigning a corresponding discrete first color component intensity value to the first variable at each time of the plurality of corresponding times;

(ii) the second color component has a corresponding plurality of discrete second color component intensity values, and further wherein the mapping includes assigning a corresponding discrete second color component intensity value to the second variable at each time of the plurality of corresponding times; and (iii) the plurality of time-series datasets includes the third time-series dataset and the third color component has a corresponding plurality of discrete third color component intensity values, and further wherein the mapping includes assigning a corresponding discrete third color component intensity value to the third variable at each time of the plurality of corresponding times.

12. The method of claim 10, wherein the mapping includes mapping such that intensities of the corresponding variable of each time-series dataset range between a minimum color component value and a maximum color component value.

13. The method of claim 12, wherein the minimum color component value is 0 and the maximum color component value is 255.

14. The method of claim 1, wherein the plural-component color space is one of:

(i) a two-component color space;

(ii) a three-component color space;

(iii) an RGB three-component color space;

(iv) a YUV three-component color space;

(v) a CMY three-component color space;

(vi) a four-component color space; and (vii) a color space with more than four components.

15. The method of claim 1, wherein the first variable includes one of:

(i) a slurry flow rate of a slurry stream provided to the hydrocarbon well during a completion operation of the hydrocarbon well;

(ii) a proppant concentration of a proppant in the slurry stream during the completion operation of the hydrocarbon well;

(iii) a pressure generated within a wellbore when the slurry stream is provided to the hydrocarbon well during the completion operation of the hydrocarbon well;

(iv) a flow resistance of the hydrocarbon well during the completion operation of the hydrocarbon well;

(v) a water production rate during production from the hydrocarbon well;

(vi) a liquid hydrocarbon production rate during production from the hydrocarbon well;

(vii) a gaseous hydrocarbon production rate during production from the hydrocarbon well;

(viii) total production from the hydrocarbon well; and (ix) hydrocarbon production from the hydrocarbon well.

16. The method of claim 15, wherein the second variable includes another one of:

(i) the slurry flow rate of the slurry stream provided to the hydrocarbon well during the completion operation of the hydrocarbon well;

(ii) the proppant concentration of the proppant in the slurry stream during the completion operation of the hydrocarbon well;

(iii) the pressure generated within the wellbore when the slurry stream is provided to the hydrocarbon well during the completion operation of the hydrocarbon well;

(iv) the flow resistance of the hydrocarbon well during the completion operation of the hydrocarbon well;

(v) the water production rate during production from the hydrocarbon well;

(vi) the liquid hydrocarbon production rate during production from the hydrocarbon well;

(vii) the gaseous hydrocarbon production rate during production from the hydrocarbon well;

(viii) the total production from the hydrocarbon well; and (ix) the hydrocarbon production from the hydrocarbon well.

17. The method of claim 15, wherein the plurality of time-series datasets includes the third time-series dataset and the third variable includes yet another one of:

(i) the slurry flow rate of the slurry stream provided to the hydrocarbon well during the completion operation of the hydrocarbon well;

(ii) the proppant concentration of the proppant in the slurry stream during the completion operation of the hydrocarbon well;

(iii) the pressure generated within the wellbore when the slurry stream is provided to the hydrocarbon well during the completion operation of the hydrocarbon well;

(iv) the flow resistance of the hydrocarbon well during the completion operation of the hydrocarbon well;

(v) the water production rate during production from the hydrocarbon well;

(vi) the liquid hydrocarbon production rate during production from the hydrocarbon well;

(vii) the gaseous hydrocarbon production rate during production from the hydrocarbon well;

(viii) the total production from the hydrocarbon well; and (ix) the hydrocarbon production from the hydrocarbon well.

18. Non-transitory computer-readable storage media including computer-executable instructions that, when executed, direct a display to display a vector map according to a method of interpreting a plurality of time-series datasets generated from operation of a hydrocarbon well, the method comprising:

obtaining the plurality of time-series datasets, wherein the plurality of time-series datasets is generated from an operation of a hydrocarbon well and includes a first time-series dataset that includes values of a first variable at a plurality of corresponding times, a second time-series dataset that includes values of a second variable at the plurality of corresponding times, and a third time-series dataset that includes values of a third variable at the plurality of corresponding times;

displaying a vector map, wherein the vector map includes a time axis and a plurality of points distributed along the time axis at the plurality of corresponding times, wherein a color of each point of the plurality of points is defined in a plural-component color space and includes a first color component at a first intensity, a second color component at a second intensity, and a third color component at a third intensity, wherein the color of each point of the plurality of points comprises a composite color formed by combining the first color component, the second color component, and the third color component such that each point of the plurality of points represents a combination of various magnitudes of at least the first variable, the second variable and the third variable at a particular point in time and further wherein:

(i) the first intensity at a given time of the plurality of corresponding times is based upon a magnitude of the first variable at the given time;

(ii) the second intensity at the given time is based upon a magnitude of the second variable at the given time; and (iii) the third intensity at the given time is based upon a magnitude of the third variable at the given time; and making an operational change based on the vector map, wherein the operational change comprises modifying at least one parameter of a subsequent operation performed on the hydrocarbon well.

19. A hydrocarbon well, comprising:

a wellbore extending within a subsurface region;

a computing device; and a display;

wherein the computing device is programmed to direct the display to display a vector map utilizing a method of interpreting a plurality of time-series datasets generated from operation of the hydrocarbon well, the method comprising:

obtaining the plurality of time-series datasets, wherein the plurality of time-series datasets is generated from an operation of a hydrocarbon well and includes a first time-series dataset that includes values of a first variable at a plurality of corresponding times, a second time-series dataset that includes values of a second variable at the plurality of corresponding times, and a third time-series dataset that includes values of a third variable at the plurality of corresponding times;

displaying a vector map, wherein the vector map includes a time axis and a plurality of points distributed along the time axis at the plurality of corresponding times, wherein a color of each point of the plurality of points is defined in a plural-component color space and includes a first color component at a first intensity, a second color component at a second intensity, and a third color component at a third intensity, wherein the color of each point of the plurality of points comprises a composite color formed by combining the first color component, the second color component, and the third color component such that each point of the plurality of points represents a combination of various magnitudes of at least the first variable, the second variable and the third variable at a particular point in time, and further wherein:

(i) the first intensity at a given time of the plurality of corresponding times is based upon a magnitude of the first variable at the given time; and (ii) the second intensity at the given time is based upon a magnitude of the second variable at the given time; and (iii) the third intensity at the given time is based upon a magnitude of the third variable at the given time; and making an operational change based on the vector map, wherein the operational change comprises modifying at least one parameter of a subsequent operation performed on the hydrocarbon well.

20. A method, comprising:

visually using a vector map to facilitate human interpretation of a plurality of time-series datasets generated from an operation of a hydrocarbon well, wherein the vector map includes a time axis and represents multiple variables at each point in time as different color components within a multi-color components space using different intensities of each color component to represent different magnitudes of each of the multiple variables at each point in time and the color of each point along the time axis comprises a composite color formed by combining the color components such that each point represents a combination of various magnitudes of the multiple variables at a respective given time; and making an operational change based on the vector map, wherein the operational change comprises modifying at least one parameter of a subsequent operation performed on the hydrocarbon well.

* * * * *